US011140471B2

(12) United States Patent
Mansfield et al.

(10) Patent No.: US 11,140,471 B2
(45) Date of Patent: Oct. 5, 2021

(54) MULTIPLE DISPERSION STANDALONE STEREO LOUDSPEAKERS

(71) Applicant: Dolby Laboratories Licensing Corporation, San Francisco, CA (US)

(72) Inventors: Warren Mansfield, Petaluma, CA (US); Alan J. Seefeldt, Alameda, CA (US); Peter Michael Razukas, San Anselmo, CA (US); Arun Sambandam, Belmont, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 80 days.

(21) Appl. No.: 16/489,364

(22) PCT Filed: Feb. 28, 2018

(86) PCT No.: PCT/US2018/020338
§ 371 (c)(1),
(2) Date: Aug. 28, 2019

(87) PCT Pub. No.: WO2018/160776
PCT Pub. Date: Sep. 7, 2018

(65) Prior Publication Data

US 2020/0077178 A1 Mar. 5, 2020

Related U.S. Application Data

(60) Provisional application No. 62/465,255, filed on Mar. 1, 2017, provisional application No. 62/626,595, filed on Feb. 5, 2018.

(51) Int. Cl.
*H04R 1/26* (2006.01)
*H04R 1/02* (2006.01)
(Continued)

(52) U.S. Cl.
CPC ..... *H04R 1/26* (2013.01); *H04R 1/02* (2013.01); *H04R 3/14* (2013.01); *H04R 5/02* (2013.01);
(Continued)

(58) Field of Classification Search
CPC ... H04R 1/26; H04R 1/02; H04R 3/14; H04R 5/02; H04R 27/00; H04R 2227/003; H04R 2420/07; H04S 2400/03
See application file for complete search history.

(56) References Cited

U.S. PATENT DOCUMENTS 4,006,308 A 2/1977 Ponsgen
4,179,585 A 12/1979 Herrenschmidt
(Continued)

FOREIGN PATENT DOCUMENTS

CN 103004182 3/2013
GB 841440 A 7/1960
(Continued)

*Primary Examiner* — Alexander Krzystan
*Assistant Examiner* — Julie X Dang

(57) ABSTRACT

Embodiments are directed to a speaker system that contains an array of multiple dispersion drivers that creates an expansive acoustic pattern to playback multi-channel audio content through a standalone speaker. The speaker system comprises an interface receiving stereo audio; an upmixer generating surround sound formatted audio from the stereo audio including one or more height channels; a virtualizer/downmixer component coupled to the upmixer and generating speaker feeds for two or more loudspeaker output sections, configured to play back the stereo audio, wherein each output section is further configured to play its own dedicated stereo audio signals; and a set of drivers each coupled to a respective output section and configured to project sound in at least two different dispersion patterns.

14 Claims, 6 Drawing Sheets

(51) Int. Cl.

| | |
|---|---|
| ***H04R 3/14*** | (2006.01) |
| ***H04R 5/02*** | (2006.01) |
| ***H04R 27/00*** | (2006.01) |
| ***H04S 7/00*** | (2006.01) |

(52) U.S. Cl.
CPC ..... *H04R 27/00* (2013.01); *H04S 7/30* (2013.01); *H04R 2227/003* (2013.01); *H04R 2227/005* (2013.01); *H04R 2420/07* (2013.01); *H04S 2400/03* (2013.01)

(56) References Cited

U.S. PATENT DOCUMENTS

| | | | | |
|---|---|---|---|---|
| 4,256,922 | A | 3/1981 | Goerike | |
| 4,753,317 | A | 6/1988 | Flanders | |
| 4,837,826 | A * | 6/1989 | Schupbach | H04R 5/02 381/308 |
| 5,809,153 | A | 9/1998 | Aylward | |
| 8,175,304 | B1 | 5/2012 | North | |
| 8,687,815 | B2 | 4/2014 | Ong | |
| 8,967,323 | B1 | 3/2015 | Grenier | |
| 9,167,369 | B2 | 10/2015 | Takumai | |
| 9,185,490 | B2 | 11/2015 | Starobin | |
| 10,015,619 | B1 * | 7/2018 | Lee | H04R 3/12 |
| 2012/0185769 | A1 | 7/2012 | Whitley | |
| 2015/0172817 | A1 * | 6/2015 | Tsakiris | H04R 1/20 381/304 |
| 2015/0223002 | A1 * | 8/2015 | Mehta | H04S 7/30 381/303 |
| 2015/0271620 | A1 * | 9/2015 | Lando | H04S 5/005 381/18 |
| 2017/0127211 | A1 | 5/2017 | Crockett | |
| 2017/0289723 | A1 * | 10/2017 | Yoo | H04S 7/30 |

FOREIGN PATENT DOCUMENTS

| | | | | |
|---|---|---|---|---|
| WO | 2015187714 | A1 | 12/2015 | |
| WO | WO-2015187714 | A1 * | 12/2015 | H04R 1/288 |
| WO | 2017030914 | A1 | 2/2017 | |

* cited by examiner

400

| Speaker Description | Front Speaker | Side Speakers | Height Speakers |
|---|---|---|---|
| Single Front<br>No Sides<br>No Heights | 1 | 0 | 0 |
| | (L+C+R+LS+RS+LTM+RTM) | n/a | n/a |
| | | | |
| Single Front<br>With Sides<br>No Heights | 1 | 2 | 0 |
| | (C) | (L+LS+LTM), (R+RS+RTM) | n/a |
| | | | |
| Single Front<br>With Sides<br>Single Height | 1 | 2 | 1 |
| | (C) | (L+LS), (R+RS) | (LTM+RTM) |
| | | | |
| Single Front<br>With Sides<br>Double Height | 1 | 2 | 2 |
| | (C) | (L+LS), (R+RS) | (LTM), (RTM) |
| | | | |
| Single Front<br>No Sides<br>Double Height | 1 | 0 | 2 |
| | (L+C+R) | n/a | (LS+LTM), (RS+RTM) |
| | | | |
| Single Front<br>No Sides<br>Single Height | 1 | 0 | 1 |
| | (L+C+R) | n/a | (LS+LTM+RS+RTM) |

FIG. 4

500

| Speaker Description | Front Speaker | Side Speakers | Height Speakers |
|---|---|---|---|
| Two Front<br>No Sides<br>No Heights | 2 | 0 | 0 |
| 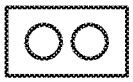 | (L+C+LS+LTM),<br>(R+C+RS+RTM) | n/a | n/a |
| | | | |
| Two Front<br>With Sides<br>No Heights | 2 | 2 | 0 |
| 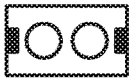 | (L+C), (R+C) | (LS+LTM), (RS+RTM) | n/a |
| | | | |
| Two Front<br>With Sides<br>Single Height | 2 | 2 | 1 |
| 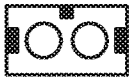 | (L+C), (R+C) | (LS), (RS) | (LTM+RTM) |
| | | | |
| Two Front<br>With Sides<br>Double Height | 2 | 2 | 2 |
| 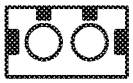 | (L+C), (R+C) | (LS), (RS) | (LTM), (RTM) |
| | | | |
| Two Front<br>No Sides<br>Double Height | 2 | 0 | 2 |
| 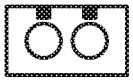 | (L+C+LS), (R+C+RS) | n/a | (LTM), (RTM) |
| | | | |
| Two Front<br>No Sides<br>Single Height | 2 | 0 | 1 |
| 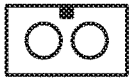 | (L+C+LS), (R+C+RS) | n/a | (LTM+RTM) |

FIG. 5

600

| Speaker Description | Front Speaker | Side Speakers | Height Speakers |
|---|---|---|---|
| Three Front<br>No Sides<br>No Heights | 3 | 0 | 0 |
| 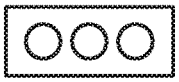 | (L+LS+LTM), (C),<br>(R+RS+RTM) | n/a | n/a |
| | | | |
| Three Front<br>With Sides<br>No Heights | 3 | 2 | 0 |
| 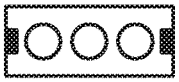 | (L), (C), (R) | (LS+LTM), (RS+RTM) | n/a |
| | | | |
| Three Front<br>With Sides<br>Single Height | 3 | 2 | 1 |
| 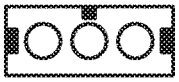 | (L), (C), (R) | (LS), (RS) | (LTM+RTM) |
| | | | |
| Three Front<br>With Sides<br>Double Height | 3 | 2 | 2 |
| 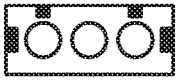 | (L), (C), (R) | (LS), (RS) | (LTM), (RTM) |
| | | | |
| Three Front<br>No Sides<br>Double Height | 3 | 0 | 2 |
| 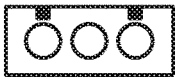 | (L+LS), (C), (R+RS) | n/a | (LTM), (RTM) |
| | | | |
| Three Front<br>No Sides<br>Single Height | 3 | 0 | 1 |
| 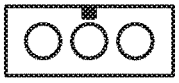 | (L+LS), (C), (R+RS) | n/a | (LTM+RTM) |

FIG. 6

MULTIPLE DISPERSION STANDALONE STEREO LOUDSPEAKERS

FIELD OF THE INVENTION

One or more implementations relate generally to stereo speaker systems, and more specifically to standalone speakers with multiple dispersion drivers.

BACKGROUND

The advent of smart speaker technology has led to greatly increased use of single, small or portable loudspeakers that are placed centrally in a home or office. Smart speakers are typically embodied in wireless speaker boxes that provide interactive functions to allow users to use voice commands to access and control various functions, such as home entertainment, facility control, and information functions. For example, such speakers may provide the main user interface for certain "smart home" installations that allow a user to speak commands to set security/lighting/heating controls, play television or music content, give answers, provide news or encyclopedic information, and so on. As such, smart speakers may be integrated into home automation systems that provide compatibility across a number of services and platforms, with peer-to-peer connection through mesh networking and the like. They can be implemented as standalone devices or devices that are accessed and controlled through applications or home automation software executed on a host computer, smartphone, or similar device.

Smart speakers can encompass a wide variety of integrated audio input/output devices, but typically include a microphone for receiving user voice commands and a simple mono or stereo speaker configuration of either one or two speakers in a linear array. Present smart speakers are typically provided as small, unobtrusive, and elegantly designed boxes that fit in a central location of a home or office. Thus, simple cube or cylindrical form factors are usually favored for such speakers. Single speaker systems may also feature multi-driver configurations, such as a midrange and a tweeter output section for the left channel and another midrange and tweeter output section for the right channel, as well as a common bass woofer which reproduces left and right redirected and summed bass output.

Although such speakers are often used for playback of audio content, such as music or A/V programs, present smart speakers are not designed or built for very high quality audio playback. Speaker sizes are typically small (e.g., 3" to 5" drivers) in single or dual-driver arrays, and cabinet sizes are typically limited to footprints of around 4 to 5 square inches. Present smart speakers thus provide only low to mid-quality audio playback of monophonic or stereo audio content. They are not particularly suitable for home theatre use or to provide playback of high quality or spatial audio content. Even though such speakers may be capable of playing back multi-channel audio content (e.g., 5.1 surround sound), they are so limited in sound dispersion and playback separation so that it is always apparent that the sound is coming from a single small speaker source in the center of the room.

What is needed, therefore, is a smart speaker or small form-factor speaker system that projects sound around a room and provides comprehensive audio playback of advanced audio formats.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to a speaker system that contains an array of multiple dispersion drivers that creates an expansive acoustic pattern to playback multi-channel audio content through a standalone speaker. The speaker system may comprise two or more loudspeaker output sections, configured to play back stereo audio signals, wherein each output section is further configured to play its own dedicated stereo audio signals, a front firing driver configured to project sound in a relatively broad dispersion pattern; and a side firing driver pair configured to project sound in a relatively narrow dispersion pattern. It may further comprise an upward firing driver configured to project sound in the relatively narrow dispersion pattern.

Embodiments are further directed to a speaker system comprising two or more loudspeaker output sections, configured to play back stereo audio signals, wherein each output section is further configured to play its own dedicated stereo audio signals, a front firing driver configured to project sound in a relatively broad dispersion pattern; and a side firing driver pair configured to project sound in a relatively narrow dispersion pattern.

Embodiments are yet further directed to methods of making and using or deploying the speakers, circuits, and driver designs that optimize the rendering and playback of stereo, surround, or immersive sound content using processing circuits and certain acoustic design guidelines for use in an audio playback system.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 4 illustrates various different speaker configurations for a single front driver configuration with varying numbers of side, and height speakers, under some embodiments.

FIG. 5 illustrates various different speaker configurations for a single front driver configuration with varying numbers of side, and height speakers, under some embodiments.

FIG. 6 illustrates various different speaker configurations for a single front driver configuration with varying numbers of side, and height speakers, under some embodiments.

DETAILED DESCRIPTION

Figure 1:
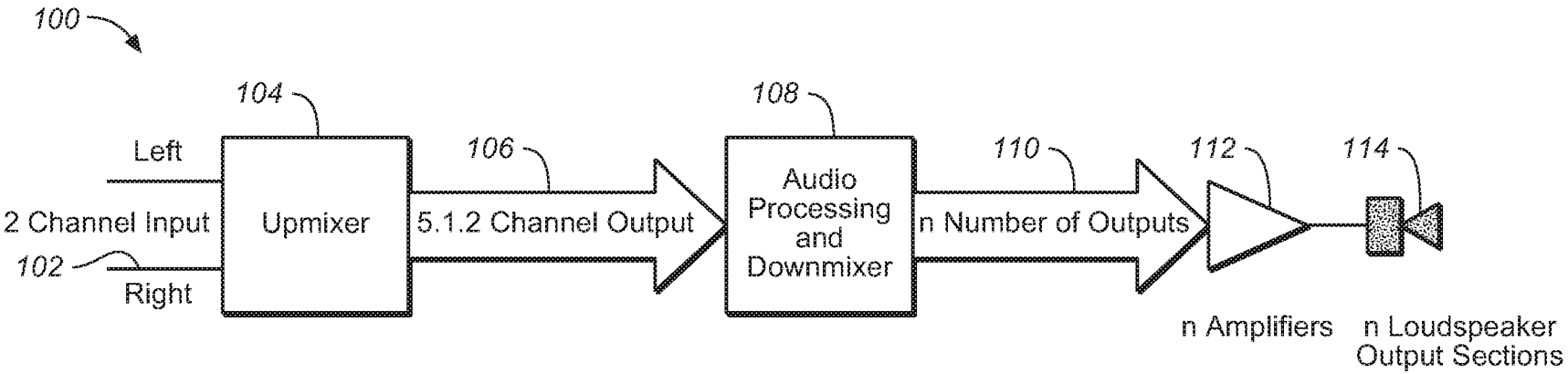
FIG. 1 is a block diagram that illustrates an audio processing system for a standalone speaker, under some embodiments.

Systems and methods are described for speakers in a standalone system or smart speaker unit that creates an expansive audio pattern for playback of multi-channel audio content. Aspects of the one or more embodiments described herein may be implemented in or used in conjunction with an audio or audio-visual (AV) system that processes source audio information in a mixing, rendering and playback system that includes one or more computers or processing devices executing software instructions.

Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on (i.e., a collection of channels as just defined); the term "object" means one or more audio channels with a parametric source description, such as apparent source position (e.g., 3D coordinates), apparent source width, etc.; "object-based audio" means a collection of objects as just defined; and "immersive audio," (alternatively "spatial audio") means channel-based and object or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content. The term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers. The terms "driver" and "speaker" may be used interchangeably when referring to a single-driver speaker. The terms "speaker feed" or "speaker feeds" may mean an audio signal sent from an audio renderer to a speaker for sound playback through one or more drivers.

Embodiments are directed to loudspeakers or speaker systems for use in sound rendering system that is configured to work with various sound formats including monophonic, stereo, and multi-channel (surround sound) formats. Another possible sound format and processing system may be referred to as an "immersive audio system," or "spatial audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio and object-based audio. Such a combined approach provides greater coding efficiency and rendering flexibility compared to either channel-based or object-based approaches taken separately.

Standalone Speaker System

In general, accurate and effective playback of complex stereo, multi-channel or immersive audio content requires speakers that disperse sound in an expansive manner. This helps radiate sound around the room so that it does not sound like it is emanating from a single small speaker source.

In an embodiment, a single speaker system comprises two loudspeaker output sections to play back stereo content. Each output section is driven by its own dedicated signal, so that none of the loudspeaker output sections are wired in parallel. This provides the benefit of using more than two loudspeaker output sections along with an upmixing algorithm and other processing to provide a superior listening experience in a small form factor single speaker. The goal of this improved listening experience is to make the speaker sound much bigger than in actually is, essentially forming an acoustic "bubble" around the speaker expanding acoustically in size both horizontally and vertically. This effect helps preserve the image and integrity of the correlated audio, such as vocals, and expanding the non-correlated audio, such as ambience.

FIG. 1 is a block diagram that illustrates an audio processing system for a standalone speaker, under some embodiments. For the embodiment of system 100, the audio input 102 comprises standard 2-channel stereo audio having separate right (R) and left (L) audio signals. The stereo audio is input to an upmixer 104 that creates an upmixed 5.1.2 channel output 106 from a stereo input. Although FIG. 1 shows upmixed output 106 as being in the 5.1.2 surround sound format, it should be noted that other upmixed outputs are also possible, such as 7.x.y, 9.x.y, and so on. Similarly, the input 102 is typically stereo, as shown, but can also be of other formats, such as monophonic or surround sound format, as well. The upmixed audio may be regular surround format (e.g., 5.x, 7.x, and so on), where the .x refers to the number of subwoofer or low frequency effect (LFE) channels; or it may be a surround sound format having height elements (e.g., 5.x.y, 7.x.y, and so on), where the .y refers to the number of height channels.

In an embodiment, various processing techniques through processor 108 are applied to the upmixed output (5.1.2) channels 106 including virtualization and perceptual height filtering for the 0.2 height channels. This output is downmixed in component 108 to produce n output signals 110, which are then amplified by amplifier stage 112 to produce the loudspeaker feeds to drive the output sections for standalone speaker 114. The downmixer thus downmixes the processed 5.1.2 (or other) channels to the appropriate driver configuration of the standalone speaker.

Figure 2:
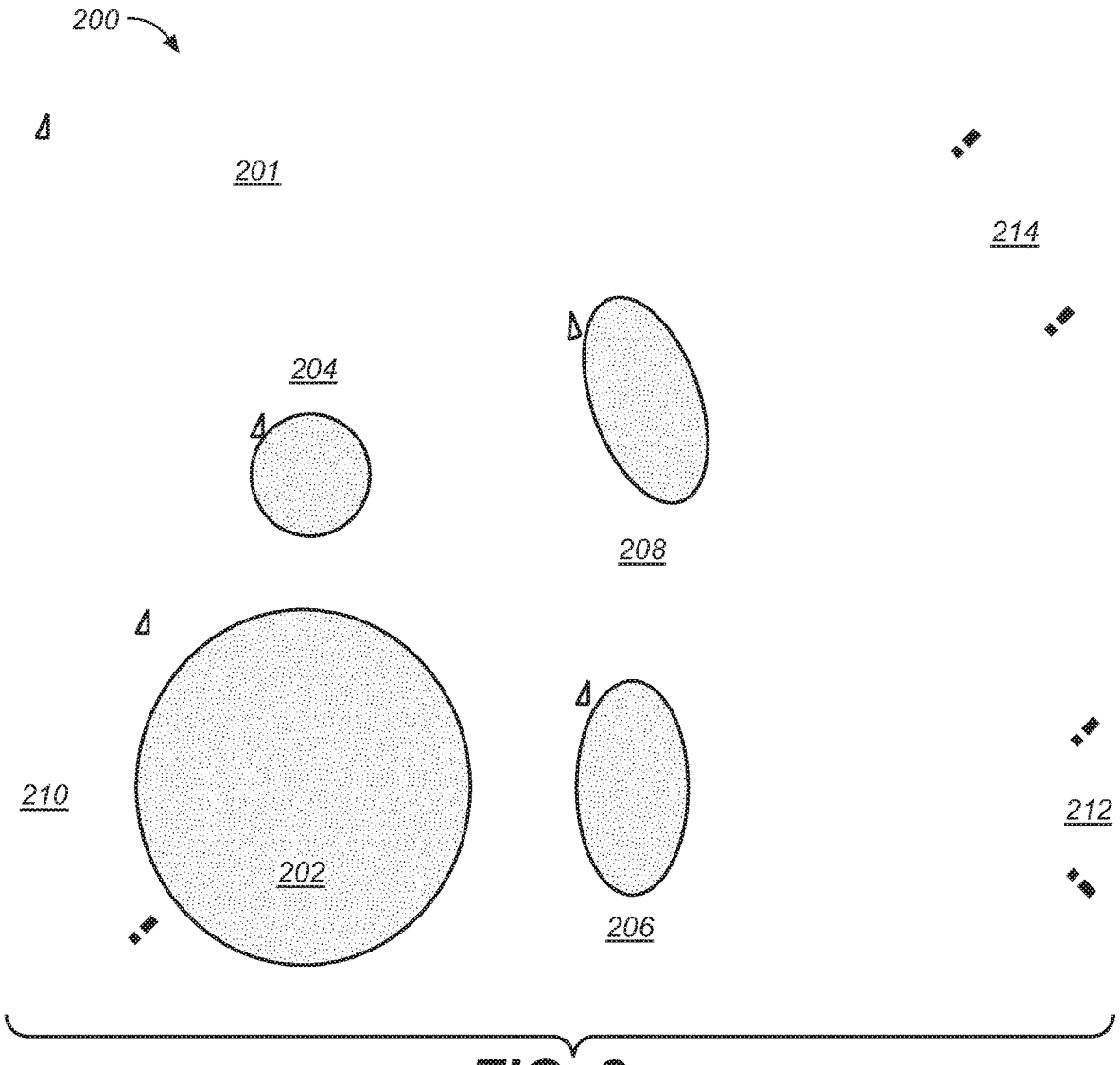
FIG. 2 illustrates a standalone speaker having multiple dispersion drivers, under some embodiments.

In an embodiment, speaker 114 comprises a single standalone speaker that has multiple drivers having different dispersion characteristics. FIG. 2 illustrates a standalone speaker having multiple dispersion drivers, under some embodiments. As shown in FIG. 2, speaker 200 comprises a single cabinet 201 housing a number of drivers 202 to 208. The drivers are arranged in front, side, and height drivers to provide respective individual drivers for certain upmixed surround sound components, such a 5.1.2, or any x.y.z configuration, with x direct channels, y LFE channels, and z height channels. For the embodiment of FIG. 2, driver 202 represents a front firing speaker, which may be either a midrange or woofer driver along with a separate front firing tweeter 204. Alternatively, a single front driver, such as a coaxial (two or three-way) driver may embody the front firing driver. The front firing driver or drivers are configured to produce a broad acoustic dispersion pattern 210. A broad dispersion pattern constitutes relatively little directivity of the output audio waves.

Speaker 200 also includes side-firing driver 206 on at least one side of cabinet 201. This speaker is configured to produce a relatively narrow dispersion pattern 212. One or more angled or height drivers 208 may also be provided, which also project in a narrow dispersion pattern 214. The height driver or drivers 208 may be mounted in an upward-angled orientation relative to the front and side firing drivers 202 and 206, or it may be placed to fire directly upward such as through an upper surface of cabinet 201. Any practical number and orientation of drivers may be included in speaker 200, and FIG. 2 is intended to illustrate only one example configuration.

For the embodiment of FIG. 2, the narrow dispersion 212 and 214 of the side and upward firing drivers 206 and 208 is significantly less than the broad dispersion 210 of the front firing driver(s) 202 and 204. An example relationship may be a directivity of two to four times for the side and upward firing drivers relative to the front firing drivers, where the dispersion is inversely related to the directivity. In general, the differing dispersion patterns are intended to provide an enveloping audio effect such that the front firing driver set is configured to project sound in a relatively broad dispersion pattern to expand non-correlated audio content; and the side firing driver pair and upward firing driver are configured to project sound in a relatively narrow dispersion pattern to preserve directivity of correlated audio content.

The acoustic design configuration for the standalone speaker 114 of FIG. 1 thus comprises (1) a broad acoustic dispersion pattern for the front firing drivers and loudspeaker output sections (which may be a single driver or combined woofer/midrange and tweeter drivers) to provide a broad sound stage for correlated audio at the speaker; and (2) narrow acoustic dispersion pattern for the side and/or upward firing drivers and loudspeaker output sections to provide a more directional characteristic for the uncorrelated audio which would then be able to take advantage of reflective surfaces in the room, further expanding the perceived width and height of the speaker.

Specific cabinet and driver configurations may be employed to optimize or accentuate the acoustic effects of the speaker. For example, a design constraint may dictate that the side firing loudspeaker output sections shall be placed so that the majority of acoustic energy is at a 20-degree angle upwards. Likewise, the side firing loudspeaker output sections may be placed either perpendicular to the main loudspeaker enclosure or at an inward angle towards the listener of up to 20 degrees. For the height components, the upward firing drivers may be orientated so that the majority of acoustic energy is vertical or positioned slightly in towards the listening position up to 20 degrees. Though specific angle orientations are mentioned, embodiments are not so limited, and any appropriate upward or side angle orientation may be used, such as between 10 and 40 degrees upward relative to horizontal for the upward drivers, or sideward relative to vertical for the side drivers.

The frequency range that the loudspeaker output sections may be configured to operate at a range that is at least that of the upper and lower operating range of the virtualizer. Any bass management, i.e., redirected bass to a common woofer, may be done below the operating start frequency of the virtualizer to avoid cancellations in the summed output.

The standalone speaker may be of any appropriate size, shape, driver configuration, build material, and so on, based end use considerations, such as audio processing system, smart speaker or home audio applications, room size, power requirements, portability, and so on. Generally, however the standalone speaker comprises a relatively compact unit that combines front firing, side firing and upward firing drivers for playback n loudspeaker output sections 114 of FIG. 1.

Figure 3:
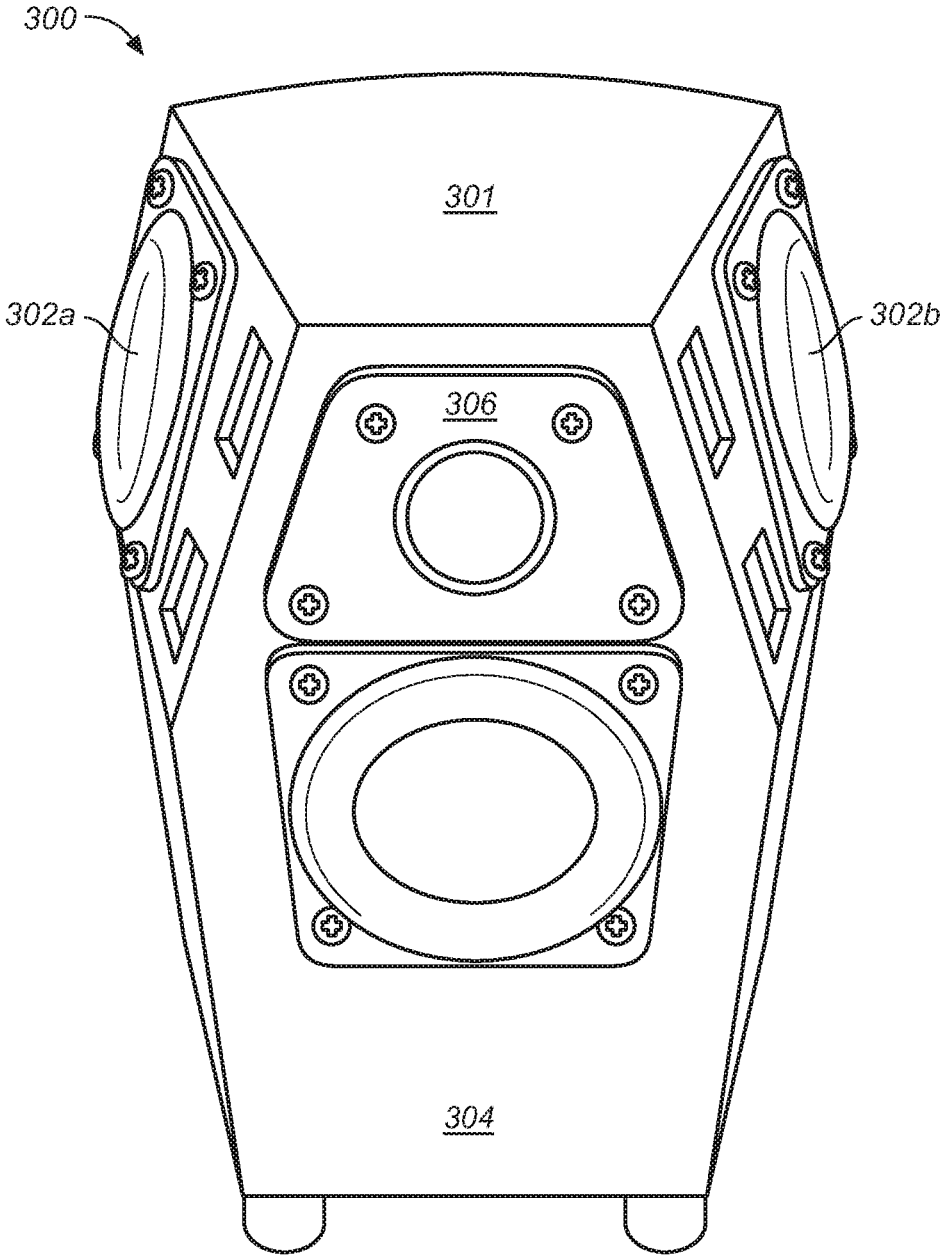
FIG. 3 illustrates an example standalone speaker unit having multiple dispersion drivers, under some embodiments.

FIG. 3 illustrates an example standalone speaker unit having multiple dispersion drivers, under some embodiments. As shown in FIG. 3, speaker 302 comprises a unitary cabinet 301 that includes a number of angled sides or faces. A front face houses a front midrange driver 304 and associated tweeter 306 that project direct audio in a broad dispersion pattern. The side faces of speaker 300 include upward angled surfaces that house respective combined side/upward firing drivers 302*a* and 302*b*. These drivers provide both the side and upward firing components in a narrow dispersion pattern.

The speaker configuration shown in FIG. 3 is an example of one particular configuration and embodiments are not so limited. Any practical number of drivers may be provided for the front, side, and upward firing output sections. As shown in FIG. 1, the processing and downmixer station 108 provides n outputs, where n is any practical number and is typically between 2 and 10.

The speaker configuration options are scalable depending on system requirements and constraints. For example, in order to maintain desired overall speaker size the side and upward firing drivers are typically limited to one to two drivers per side, while the number of front drivers may range between one and four. FIGS. 4-6 illustrate various different speaker configurations based on varying numbers of front, side, and height speakers, under some embodiments. Table 400 of FIG. 4 illustrates a number of configurations for a single front driver speaker configuration, under some embodiments; table 500 of FIG. 5 illustrates a number of configurations for a dual front driver speaker configuration, under some embodiments; and table 600 of FIG. 6 illustrates a number of configurations for a single front driver speaker configuration, under some embodiments. For each of the tables of FIGS. 4-6, the designations are as follows: L is left channel, C is center channel, R is right channel, LS is left surround, RS is right surround, LTM is left height, and RTM is right height.

Embodiments are directed to a speaker system that contains an array of multiple dispersion drivers that creates an expansive acoustic pattern to playback multi-channel audio content through a standalone speaker. As shown in FIG. 1, the speaker system 100 includes a number n of output sections connected to respective drivers. The processing circuitry 104, 108, and amplifiers 112 may be provided within the speaker system and with the drivers in the unitary cabinet 201 or external to the drivers. In this embodiment, the drivers only are contained in the cabinet and the processing circuitry and amplifiers are housed separately as standalone components, or as part of an A/V controller.

In an embodiment, the speaker may be coupled to an A/V controller or audio source through a wired or wireless link. For these embodiments, the input audio 102 of FIG. 1 may be provide by an AVR that is coupled to the speakers over a direct wired connection. In the case of a wireless link, the wireless speakers receive the input audio signal wirelessly, instead of receiving an electrical audio signal via a wire. The wireless speakers may connect to the AVR or audio source via a Bluetooth™ connection, a WiFi™ connection, or proprietary connections (e.g., using other radio frequency transmissions), which may (or may not) be based on WiFi™ standards or other standards.

As stated above, the physical dimensions, composition, and configuration of the speaker system may vary depending on system needs and constraints. The cabinet 201 may be constructed of any appropriate material, such as wood, plastic, medium density fiberboard (MDF), and so on, and may be of any appropriate thickness, such as 0.75 inches.

As shown in FIG. 1, various processing components may be used to generate the n speaker outputs 110. In system 100, these components may include a virtualizer for use with immersive audio content. In an embodiment, a speaker virtualizer 410 takes the immersive audio content in the appropriate format (e.g., Atmos 5.1.2) from the renderer and outputs this audio as channel output for the various drivers (e.g., front, side, upward and LFE speakers) of the system. The speaker virtualizer basically virtualizes the decoded audio content (e.g., DD+/JOC) to the correct speaker configuration. Thus, for example, 7.1.4 DD+/JOC content may be decoded to a 2.1.4 speaker system or 5.1.2 DD+/JOC content to 2.1.2 speaker system, using known (e.g., Dolby Atmos) speaker virtualization methods.

Other processing functions may also be performed, such as high or low-pass filtering, crossovers, and so on. In an embodiment, the speaker system may include a crossover high-pass filter operation that is performed on the height channels (e.g., denoted as the "0.2" in a 2.1.2 system) to extract all high-frequency content, specified by a cutoff frequency, out of the height channels and physically route them to the upward-firing speakers in the system. The low-frequency content remaining in the height-channels that are below the cutoff frequency, will then sent to the direct or side firing drivers. The cutoff frequency of the crossover defines the high/low pass filter frequency for the height channels to be sent to either the upward or direct firing drivers. This cutoff frequency may be set, through well-known crossover techniques, to any appropriate frequency, typically in the range of 1 kHz to 5 kHz as determined by the actual performance and physical characteristics of the upward-firing drivers relative to the direct firing drivers.

Embodiments of the speaker system may also include a virtual (or perceptual) height filter circuit applying a frequency response curve to a signal transmitted to the upward-firing driver to create a target transfer curve. The virtual height filter compensates for height cues present in sound waves transmitted directly through the listening environment in favor of height cues present in the sound reflected off the upper surface of the listening environment. Embodiments of such a virtual height cue filter may be implemented in the speaker system as described in U.S. patent application Ser. No. 62/163,502 entitled "Passive and Active Virtual Height Filter Systems for Upward-firing Speakers," filed on May 19, 2015, and which is hereby incorporated by reference in its entirety.

The processing components and audio design guidelines may be provided to speaker or equipment manufacturers/integrators in kit form to help configure existing speaker or smart speaker products.

Any processing components of FIG. 1 may be provided as hardware components that are provided to a device manufacturer for integration into a product, such as through a chipset, dedicated circuit, etc., or as firmware such as in a device level program burned into a programmable array, ASIC (application specific integrated circuit), etc., or as software executed by a processor or co-processor of the device, or any combination of hardware/firmware/software.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," and "hereunder" and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A small form-factor smart speaker system comprising:

two or more loudspeaker output sections, configured to play back stereo audio signals, wherein each output section is further configured to play its own dedicated stereo audio signals, a front firing driver configured to project sound in a relatively broad dispersion pattern; and a side firing driver pair and an upward firing driver all configured to project sound in a relatively narrow dispersion pattern, wherein the relatively broad and narrow dispersion patterns are configured to preserve an image of correlated audio content and expand non-correlated audio content to thereby form a virtual acoustic bubble around a listener when placed in a central location of a room, wherein the relatively narrow dispersion comprises a sound dispersion pattern of at least half of that produced by the relatively broad dispersion pattern.

2. The speaker system of claim 1 wherein the relatively narrow dispersion pattern of the side firing and upward firing drivers and the relatively broad dispersion pattern of the front firing driver each have corresponding inversely proportional directivities, and wherein a directivity of the side firing and upward firing drivers is on the order of two to four times the directivity of the front firing driver.

3. The speaker system of claim 2 further comprising a cabinet housing the front firing driver, side, and upward firing drivers in a single small form-factor speaker unit of approximately 4 to 5 square inches.

4. The speaker system of claim 3 wherein the upward firing driver is configured to project sound at an approximate angle of 20 degrees from horizontal into a listening room.

5. The speaker system of claim 1 further comprising an interface coupling the speaker system to an audio source over one of a wired link or a wireless link.

6. The speaker system of claim 5 wherein the wireless link comprises one of: a WiFi link, or a Bluetooth link.

7. The speaker system of claim 3 wherein the front firing drivers comprise a set of drivers including at least two of: a woofer, a midrange driver, and a tweeter.

8. The speaker system of claim 7, further comprising:

an upmixer receiving the stereo input signals and outputting surround sound audio with height components; and a virtualizer/downmixer component coupled to the upmixer and producing a number of audio outputs of each output section for amplification prior to transmission to the front, side, and upward firing drivers.

9. The speaker system of claim 8 further comprising a perceptual height filter applied to the height components.

10. The speaker system of claim 9 wherein the virtualizer/downmixer processes immersive audio content comprising channel-based audio and object-based audio including sound objects for the height components.

11. A small form-factor speaker system comprising:

an interface receiving stereo audio;

an upmixer generating surround sound formatted audio from the stereo audio including one or more height channels;

a virtualizer/downmixer component coupled to the upmixer and generating speaker feeds for two or more loudspeaker output sections, configured to play back the stereo audio, wherein each output section is further configured to play its own dedicated stereo audio signals;

a set of drivers comprising a front firing driver set, a side firing driver pair, and an upward firing driver, each coupled to a respective output section and configured to project sound in at least two different dispersion patterns including a relatively broad dispersion pattern and a relatively narrow dispersion pattern, wherein the relatively broad and narrow dispersion patterns are configured to preserve an image of correlated audio content and expand non-correlated audio content to thereby form a virtual acoustic bubble around a listener, the front firing driver configured to project sound in the broad dispersion pattern, and the side firing driver pair and the upward firing driver configured to project sound in the narrow dispersion pattern the front, and further wherein the relatively narrow dispersion pattern comprises a sound dispersion pattern of at least half of that produced by the relatively broad dispersion pattern.

12. The speaker system of claim 11 wherein the set of drivers further comprises:

a cabinet housing the front firing driver set, side firing driver pair, and upward firing driver in a single small form-factor speaker unit of approximately 4 to 5 square inches.

13. The speaker system of claim 12 wherein the relatively narrow dispersion pattern of the side firing and upward firing drivers and the relatively broad dispersion pattern of the front firing driver each have corresponding inversely proportional directivities, and further wherein a directivity of the side firing and upward firing drivers is on the order of two to four times the directivity of the front firing driver.

14. The speaker system of claim 12 wherein the front firing drivers comprise a set of drivers including at least two of: a woofer, a midrange driver, and a tweeter.

* * * * *